US008237536B2

(12) United States Patent
Takeda

(10) Patent No.: US 8,237,536 B2
(45) Date of Patent: Aug. 7, 2012

(54) THERMAL PROTECTOR

(75) Inventor: Hideaki Takeda, Saitama (JP)

(73) Assignee: Uchiya Thermostat Co., Ltd. (JP)

( * ) Notice: Subject to any disclaimer, the term of this patent is extended or adjusted under 35 U.S.C. 154(b) by 0 days.

(21) Appl. No.: 12/311,985

(22) PCT Filed: Mar. 12, 2007

(86) PCT No.: PCT/JP2007/000208

§ 371 (c)(1),
(2), (4) Date: Apr. 21, 2009

(87) PCT Pub. No.: WO2008/053575

PCT Pub. Date: May 8, 2008

(65) Prior Publication Data

US 2010/0026446 A1 Feb. 4, 2010

(30) Foreign Application Priority Data

Oct. 30, 2006 (JP) ..... 2006-294804

(51) Int. Cl.
*H01H 37/52* (2006.01)
*H01H 37/04* (2006.01)
*H01H 37/54* (2006.01)

(52) U.S. Cl. ..... 337/365; 337/340; 337/372; 337/362

(58) Field of Classification Search ..... 337/372, 337/362, 365, 340
See application file for complete search history.

(56) References Cited

U.S. PATENT DOCUMENTS

| | | | | | |
|---|---|---|---|---|---|
| 3,936,788 | A | * | 2/1976 | Uchiya | 337/372 |
| 4,414,529 | A | * | 11/1983 | Yoshioka et al. | 337/36 |
| 4,507,642 | A | * | 3/1985 | Blackburn | 337/89 |
| 4,862,133 | A | * | 8/1989 | Tabei | 337/102 |
| 4,866,408 | A | * | 9/1989 | Petraitis et al. | 337/104 |
| 5,014,035 | A | * | 5/1991 | Hamada et al. | 337/372 |
| 5,196,820 | A | * | 3/1993 | Ubukata et al. | 337/368 |
| 5,367,279 | A | * | 11/1994 | Sakai | 337/104 |
| 5,607,610 | A | * | 3/1997 | Furukawa | 219/505 |
| 5,659,285 | A | * | 8/1997 | Takeda | 337/389 |

(Continued)

FOREIGN PATENT DOCUMENTS

JP 56-110543 8/1981

(Continued)

OTHER PUBLICATIONS

"Japanese Application Serial No. 2008-523834, Official Action mailed Aug. 24, 2010", (w/ Partial English Translation), 3 pgs.

*Primary Examiner* — Bradley Thomas
(74) *Attorney, Agent, or Firm* — Schwegman, Lundberg & Woessner, P.A.

(57) ABSTRACT

Various embodiments include a thermal protector, including the rear end of a movable plate fixed to one end of a resin base and a pair of terminals for connection with an external circuit fixed to the other end thereof. Fixed contacts are formed on the fixed portions of the terminals, and the movable contact of the movable plate is disposed opposed to the fixed contacts. A bimetal element engaged with the center of the movable plate is set to project upward at normal temperature, thus bringing the movable contact into pressure contact with the fixed contacts with prescribed contact pressure. The bimetal element consists of an inversion area wherein the inversion area has no portion overlapping the conduction path area of load current.

10 Claims, 6 Drawing Sheets

U.S. PATENT DOCUMENTS

| | | | | |
|---|---|---|---|---|
| 5,796,327 | A * | 8/1998 | Smith | 337/342 |
| 5,831,508 | A * | 11/1998 | Ikeda | 337/35 |
| 6,154,117 | A * | 11/2000 | Sato et al. | 337/365 |
| 6,281,780 | B1 * | 8/2001 | Sugiyama et al. | 337/137 |
| 6,396,381 | B1 * | 5/2002 | Takeda | 337/377 |
| 6,559,752 | B1 * | 5/2003 | Sienkiewicz et al. | 337/53 |
| 6,577,223 | B2 * | 6/2003 | Takeda | 337/377 |
| 6,597,273 | B2 * | 7/2003 | Takeda | 337/327 |
| 6,633,222 | B2 * | 10/2003 | Nagai et al. | 337/365 |
| 6,756,876 | B2 * | 6/2004 | Sullivan et al. | 337/111 |
| 7,026,907 | B2 * | 4/2006 | Takeda | 337/85 |
| 2004/0075526 | A1 * | 4/2004 | Takeda | 337/36 |

FOREIGN PATENT DOCUMENTS

| | | | |
|---|---|---|---|
| JP | 11-260221 | A | 9/1999 |
| JP | 3724178 | B2 | 12/2005 |

* cited by examiner

THERMAL PROTECTOR

RELATED APPLICATIONS

This application is a nationalization under 35 U.S.C. 371 of PCT/JP2007/000208, filed Mar. 12, 2007 and published as WO 2008/053575 on May 8, 2008, which claimed priority under U.S.C. 119 to Japanese Application No. 2006-294804, filed Oct. 30, 2006; which applications and publications are incorporated herein by reference and made a part hereof.

TECHNICAL FIELD

The invention discussed herein is related to a thermal protector for sensing temperature and excess current and shutting down current.

BACKGROUND ART

Conventionally, a thermal protector is structured to shut down a conduction path by the inversion operation of a bimetal element. Then, the bimetal element itself or a movable plate jointed to the bimetal element forms a conduction part for shutting down the conduction path.

Therefore, the thermal protector is structured so that the bimetal element part is always heated by itself with Joule heating in a current path where current flows from one terminal to the other terminal regardless of the position of a contact for shut-down.

Therefore, the bimetal element is operated by not only ambient temperature but also the influence of Joule heating generated by the bimetal element itself. Thus, an inconvenience that the shutting operation is caused at lower ambient temperature in which the shutting operation is not needed is often seen.

Therefore, in order to avoid such an inconvenience, a thermal protector structure in which no conduction part is formed in portions other than a contact part of the bimetal element is proposed (for example, see Japanese Patent No. 3724178 (Japanese Laid-open Patent Publication No. H11-260221).

FIG. 1 is a perspective view showing the structure of such a thermal protector for forming no conduction part in portions other than the contact part of the bimetal element.

As illustrated in FIG. 1, in this thermal protector 1, two plane-shaped fixed electrodes 2 and 3 go through the lower section of a resin base 4 being a support member from front to rear and are supported by the resin base 4.

At one ends of the two fixed electrodes 2 and 3, fixed contacts 5 and 6 are formed and to the other ends of the two fixed electrodes 2 and 3 projected from the resin base 4 opposed to the fixed contacts 5 and 6, lead wires 7 and 8 are connected.

On the surface of the resin base 4 positioned above the end side having the fixed contacts 5 and 6 of the two fixed electrodes 2 and 3, one end of a movable electrode support plate 9 is fixed. Then, to this movable electrode support plate 9, one end of a bimetal element 10 to be inverted by heat is fixed and the bimetal element 10 is supported.

Then, at the other end of the bimetal element 10, one movable contact 11 is provided opposed to the fixed contacts 5 and 6.

In this thermal protector 1, as illustrated in FIG. 1, the movable contact 11 of the bimetal element 10 is contacted on the fixed contacts 5 and 6 by pressure at normal temperature. Thus, a conduction path is formed between the lead lines 7 and 8 via the fixed electrode 2, the fixed contact 5, the movable contact 11, the fixed contact 6 and the fixed electrode 3 in that order.

Then, the bimetal element 10 is structured in such a way that the bimetal element 10 may be inverted at ambient temperature equal or more than prescribed temperature, the movable contact 11 may be separated from the fixed contacts 5 and 6 and the conduction path formed between the lead lines 7 and 8 may be shut down.

However, as clearly seen in FIG. 1, the fixed electrodes 2 and 3 between the fixed contacts 5 and 6 and the resin base 4 are conduction areas and these conduction areas are disposed opposed to the bottom surface of the bimetal element 10.

Specifically, the entire surface of inversion area of the bimetal element 10, that is, 100% of the inversion area overlaps the conduction areas of the fixed electrodes 2 and 3.

In this way, although the bimetal 10 is structured not to be energized, in other words, the bimetal element 10 itself is structured not to generate heat by Joule heating, the entire inversion area of the bimetal element 10 is in such a state as to receive Joule heating generated in a conduction area by radiation and convection.

Therefore, when conduction current increases, the bimetal element 10 is inverted by not only ambient temperature but also heat generated inside the thermal protector 1 itself and the thermal protector 1 tends to be frequently operated at lower ambient temperature than its original operating temperature.

When the conduction current further increases, as described above, the thermal protector illustrated in FIG. 1, the bimetal element 10 can be inverted at normal temperature.

Specifically, practically, the thermal protector 1 is structured in such a way that there is a possibility that the thermal protector 1 may be wrongly operated despite being at ambient temperature in the usual operation range of the device when being incorporated into a device.

Accordingly, it is an object of the invention to provide a thermal protector capable of conducting large current by minimizing the influence of heat generation by conduction.

DISCLOSURE OF INVENTION

According to an aspect of the invention, a thermal protector includes a pair of terminals for connection with an external circuit, a pair of fixed contacts constituting the switch part of an electric circuit formed in the pair of the terminals, a movable plate composed of an elastic plate provided with a movable contact opposed to the pair of fixed contacts, for forming prescribed contact pressure to the pair of fixed contacts by the movable contact and a bimetal element which is inverted in the direction of bending backward at prescribed temperature to switch on/off the pair of fixed contacts. The movable plate is disposed in the direction where its one end side reverse to the other end side provided with the movable contact is getting away from the fixed contacts and the terminal. The bimetal element is structured in such a way that its one end may engage with the end side provided with the movable contact of the movable plate, the other end may engage with the end side reverse to the other end side provided with the movable contact of the movable plate and also the overlap ratio of its inversion area to the conduction path area of load current in the internal disposition space may be equal to ⅓ or less.

The bimetal element includes, for example, an inversion area and a non-inversion area. The bimetal element is structured to be disposed in the upper section of the movable plate in such a way that the non-inversion area side end may be fixed on the movable plate, the inversion area side tip may engage with the end side provided with the movable contact of the movable plate and normally the movable contact of the movable plate may be pressed toward the pair of fixed contacts.

In this case, for example, a material for fixing the end of the bimetal element on the movable plate can be also made of a charging metal and the base of the thermal protector main body can be also made of a metal insulated from the pair of terminals.

In the thermal protector of the present invention, for example, one end of the bimetal element can also engage with the movable plate in a position deviated in the direction of the end reverse to the top end provided with the movable contact of the movable plate, the other end of the bimetal element can engage with the end reverse to the end provided with the movable contact of the movable plate and also the inversion area of the bimetal element cannot overlap the conduction area of load current in the internal disposition area.

In the thermal protector of the present invention, for example, it is preferable that, for example, if the electric circuit is a DC circuit, one of the pair of terminals for connection with the external circuit is made of copper or copper alloy, the other is made of nickel or iron plated with nickel and the nickel or nickel-plated iron side and the copper or copper alloy side of the conduction direction of the DC circuit are plus and minus poles, respectively.

For example, the pair of fixed contacts and the movable contact disposed opposed to the pair of fixed contacts can be also made of the same silver family material and also can be united with the movable contact.

For example, it is also preferable that each of the pair of terminals for connection with the external circuit is composed of a plate-shaped member functioning as a heat radiation surface.

For example, PTC can be also built in the base of the thermal protector main body, the pair of terminals and the electrode of the PTC can be also connected in parallel and the bimetal element can be also held by itself with heat generated by voltage that is applied from the pair of terminals to the PTC at a release of the pair of fixed contacts.

As described above, according to the present invention, the bimetal element not only constitute no conduction path but also is arranged in a position not affected by the heat generation of the conduction path. Therefore, the bimetal element is not inverted at lower temperature than its original operating temperature. Thus, a thermal protector capable of stably conducting larger current can be provided.

EXPLANATION OF REFERENCE NUMERALS

Figure 1:
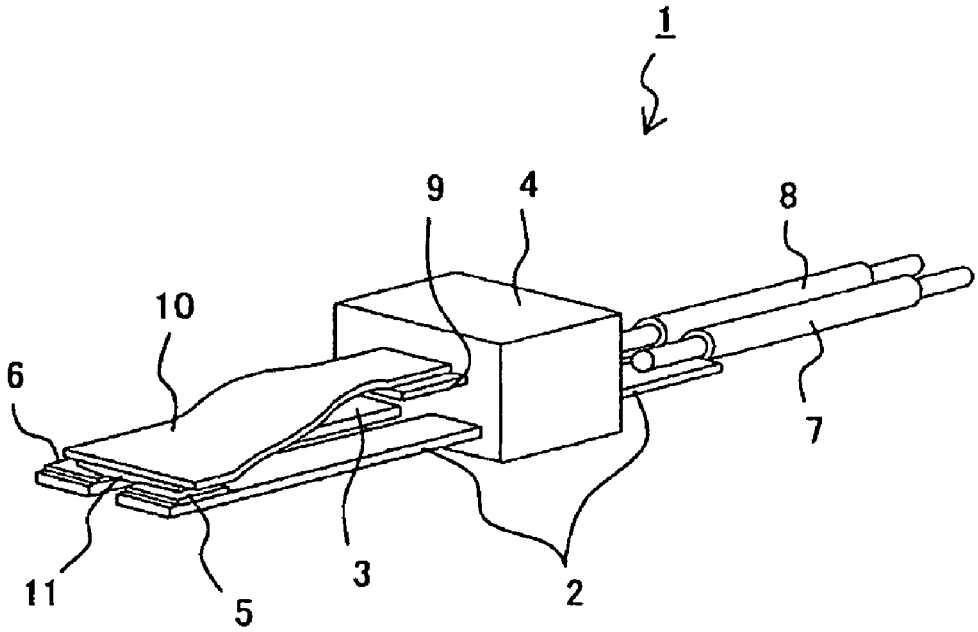
FIG. 1 (PRIOR ART)
FIG. 1 is a perspective view illustrating the structure of a conventional thermal protector for forming no conduction part in portions other than the contact part of the bimetal element.

1 Thermal protector
2 & 3 Fixed electrode
4 Resin base
5 & 6 Fixed contact
7 & 8 Lead wire
9 Movable electrode support plate
10 Bimetal element
11 Movable contact
15 Thermal protector
16(16*a* & 16*b*) Terminal
  16-1 Conduction area
17 Resin base
  17-1 Projection
  17-2 Fixing strut
18(18*a* & 18*b*) Fixed contact
19 Movable plate
  19-1 Engagement hook
  19-2 Fixing hole
  19-3 Dummy hole
21 Movable contact
22 Bimetal element
  22-1 Inversion area
    22-1-1 Conduction area overlap portion
  22-2 Non-inversion area
  22-3 Fixing hole
  22-4 Center
23 Clump
25 Thermal protector
26 Metal
27 Bimetal element
  27-1 Inversion area
  27-2 Center
28 Movable plate
  28-1 Restriction hook
  28-2 & 28-3 Hook
  28-4 Dummy hole
29 Welded portion
30 Housing
31 PTC (positive temperature coefficient)
32(32*a* & 32*b*) Electrode
33(33*a* & 33*b*) Conductive joint member
34(34*a* & 34*b*) Resistor member

BEST MODE FOR CARRYING OUT INVENTION

First Embodiment

Figure 2A:
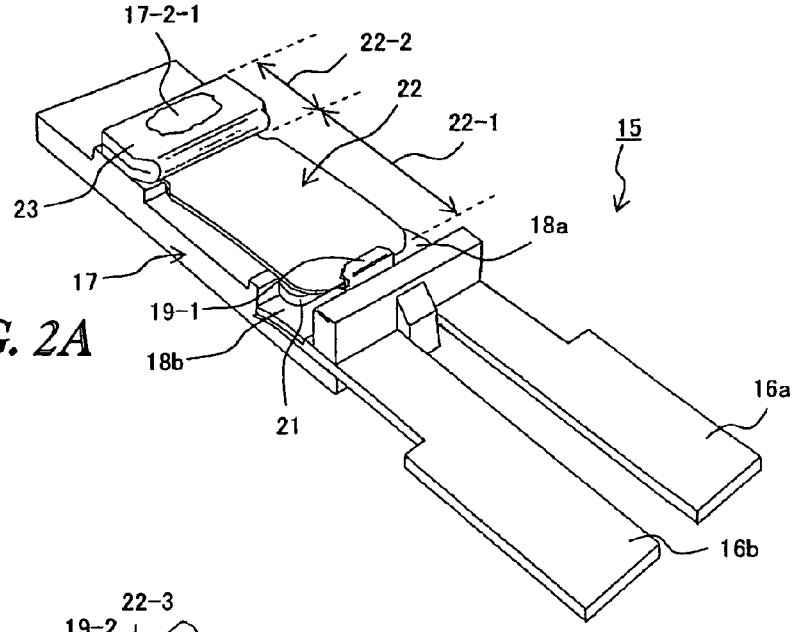
FIG. 2A is a perspective view illustrating the internal structure after removing a housing, of the thermal protector in the first preferred embodiment.
Figure 2B:
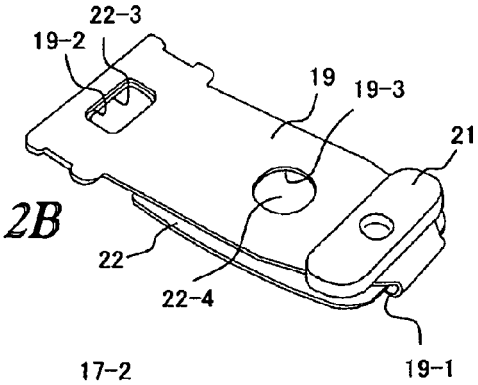
FIG. 2B is an exploded perspective view of the thermal protector illustrated in FIG. 2A (No. 1)
Figure 2C:
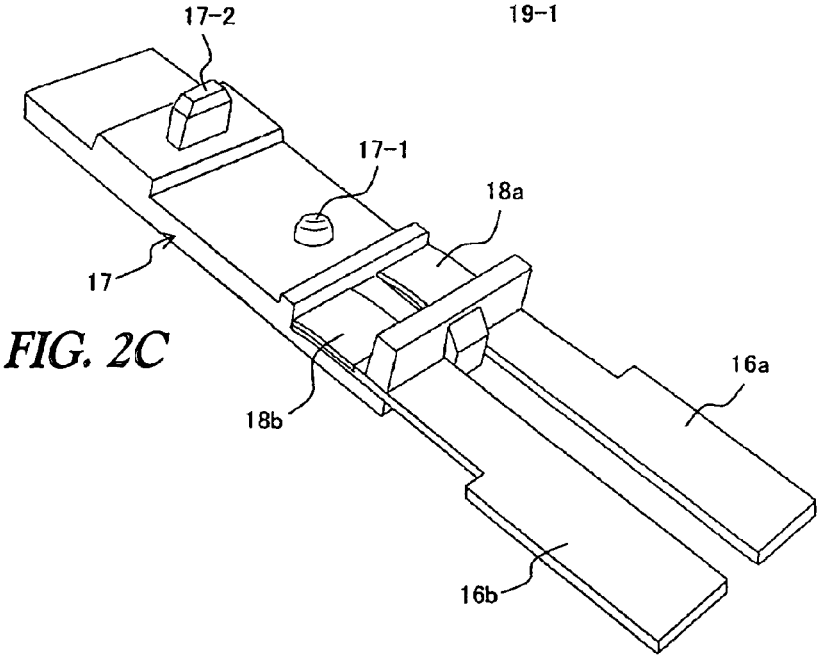
FIG. 2C is an exploded perspective view of the thermal protector illustrated in FIG. 2A (No. 2)

FIG. 2A is a perspective view illustrating the internal structure after removing a housing, of the thermal protector in the first preferred embodiment and FIGS. 2B and 2C are its exploded perspective view. In FIG. 2B, the bimetal element and the movable plate illustrated in FIG. 2A are inverted upside down.

As illustrated in FIGS. 2A, 2B and 2C, the thermal protector 15 in this preferred embodiment includes a pair of terminals 16 (16*a* and 16*b*) for connection with an external circuit. The pair of terminals 16 is fixed on a resin base 17.

Then, on the end sides fixed on the resin base 17 of the pair of terminals, a pair of fixed contacts 18(18*a* and 18*b*) are formed.

On the pair of fixed contacts 18, a movable contact 21 formed on a movable plate 19 composed of an elastic plate is also disposed opposed to the fixed contacts 18 and gives prescribed contact pressure to the fixed contacts 18.

The portion contacting the pair of fixed contacts 18 of the movable contact 21 is united and is fixed on the movable plate by caulking or welding.

Since the movable contact 21 is united instead of being separated, current flowing between the fixed contacts 18 via the movable contact 21 is directly conducted via only the movable contact 21 without being branched to the movable plate 19.

The extension portion of an end on which the movable contact 21 is formed, of the movable plate 19 is folded back to one surface side reverse to the other surface side on which the movable contact 21 is formed, to form an engagement hook 19-1.

On the movable plate 19, a rectangular fixing hole 19-2 is formed in the vicinity of the one end reverse to the other end on which the movable contact 21 is formed. Furthermore, on the movable plate 19, a circular dummy hole 19-3 is formed between the movable contact 21 and the fixing hole 19-2.

With this movable plate 19, a bimetal element 22 which drives the movable plate 19 to invert the movable plate 19 in its inversion direction at prescribed temperature via the movable contact 21 in order to switch on/off a pair of fixed contacts 18 is engaged.

The bimetal element 22 includes an inversion area 22-1 and a non-inversion area 22-2, and the end of the inversion area 22-1 side is engaged with the engagement hook 19-1 of the movable plate 19.

Then, at the end of the non-inversion area 22-2 side of the bimetal element 22, a fixing hole 22-3 in almost the same shape as the fixing hole 19-2 of the movable plate 19 is formed and this fixing hole 22-3 overlaps the fixing hole 19-2 of the movable plate 19.

On the resin base 17, a somewhat cylinder-shaped projection 17-1 is formed almost at the center and an almost rectangular parallelepiped-shaped fixing strut 17-2 is formed a little toward the one end reverse to the other end at which the terminals 16 are fixed.

When the combination of the movable plate 19 illustrated in FIG. 2B and the bimetal element 22 one end of which is engaged with this movable plate 19 is inverted upside down and is mounted on the resin base 17 illustrated in FIG. 2C, the fixing hole 19-2 of the movable plate 19 and the fixing hole 22-3 of the bimetal element 22 overlap and are fitted into the fixing strut 17-2 of the resin base 17.

Then, a clump 23 is fitted into the fixing strut 17-2 from above and the extra portion 17-2-1 of the fixing strut 17-2 that projects through the clump 23 is crushed by heat and pressure to caulk the clump 23 to the fixing strut 17-2.

Thus, the one end side reverse to the other end side provided with the movable contact 21 of the movable plate 19 and the end on the non-inversion area 22-2 side of the bimetal element 22 are fixed to the fixing strut 17-2 by the clump 23.

In this state, since the bimetal element 22 is set to be convex upward in FIG. 2A at normal temperature, the movable contact 21 of the movable plate 19 is contacted on the fixed contact 18 by prescribed contact pressure.

In this state, the tip of the projection 17-1 of the resin base 17 goes through the dummy hole 19-3 of the movable plate 19 and the projection 17-1 is disposed close to the center 22-4 of the inversion area 22-1 of the bimetal element 22.

Thus, when the bimetal element 22 is inverted at prescribed high temperature, that is, it is inverted in a concave shape upward, the end on the non-inversion area 22-2 side of the bimetal element 22 is fixed to the fixing strut 17-2 of the resin base 17 and the center 22-4 of the inversion area 22-1 abuts on the projection 17-1 of the resin base 17, whereby the end of the bimetal element 22 which is engaged with the engagement hook 19-1 of the movable plate 19 is lifted. Thus, the fixed contacts 18*a* and 18*b* are released to shut current.

Next, the positional relationship between the inversion area of the bimetal element 22 in this preferred embodiment, that is, a thermo-sensitive reaction area and the conduction path area of load current in an internal disposition space, that is, a disposition space inside the housing, which is not illustrated in FIG. 2, will be explained.

Figure 3:
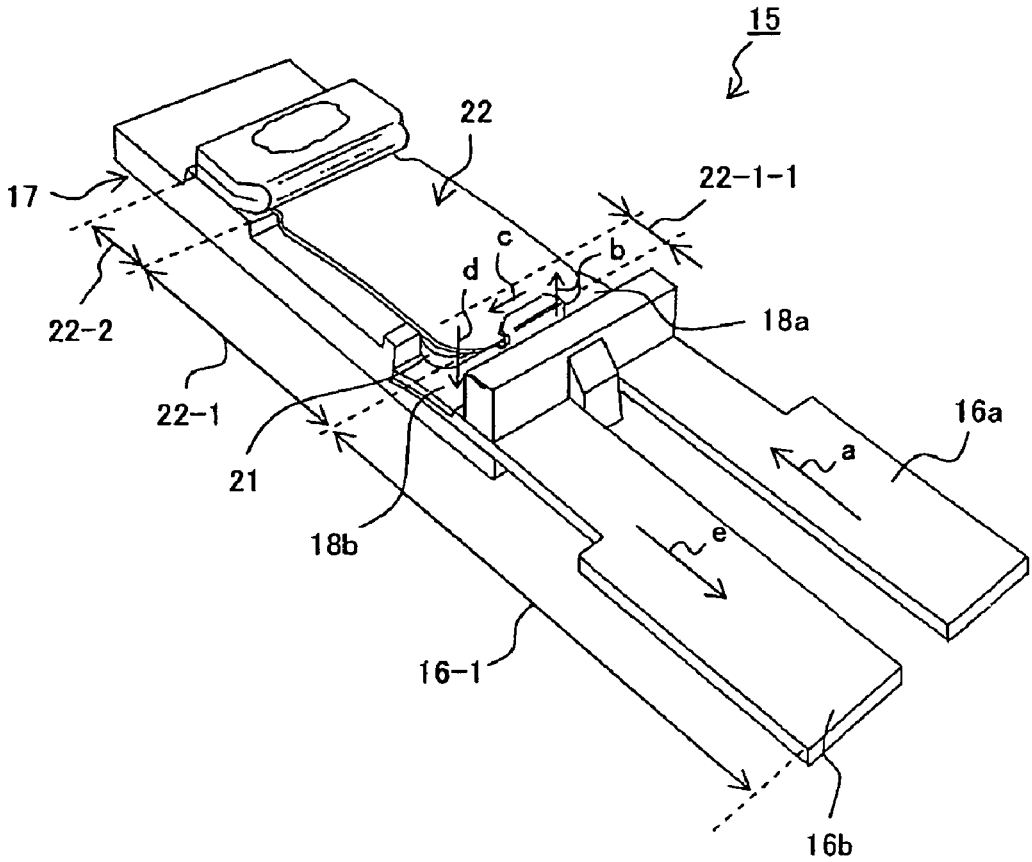
FIG. 3 is the perspective view of the thermal protector illustrated in FIG. 2A illustrating the positional relationship between the inversion area of the bimetal element and the conduction path area of load current.

FIG. 3 is the perspective view of the thermal protector 15 illustrated in FIG. 2A illustrating the internal structure of the thermal protector 15 after removing a housing.

In FIG. 3, if the terminals 16*a* and 16*b* are assumed to be plus and minus poles, respectively, when the fixed contacts 18*a* and 18*b* are closed, firstly, current flows through the terminal 16*a* as indicated by an arrow a, then flows from the fixed contact 18*a* of the terminal 16*a* to the movable contact 21 as indicated by an arrow b, further flows through the movable contact 21 as indicated by an arrow c, then flows from the movable contact 21 to the fixed contact 18*b* of the terminal 16*b* as indicated by an arrow d and then flows through the terminal 16*b* as indicated by an arrow e to form the conduction path of an external power supply.

In the conduction area 16-1 where a conduction path indicated by these arrows a, b, c, d and e is formed, the overlapping area between this conduction area 16-1 and the inversion area 22-1 of the bimetal element 22 is only an overlapping portion 22-1-2 with the movable contact 21.

The overlap range of this overlapping portion 22-1-1 is approximately ¼ of the inversion area 22-1 of the bimetal element 22 in the example illustrated in FIG. 3. This indicates that even if the bimetal element 22 is miniaturized and the size of the movable contact 21 is maintained as illustrated in FIG. 3 in order not to change the amount of current, the overlap between the conduction area 16-1 and the inversion area 22-1 of the bimetal element 22 is approximately ⅓ or less.

The one end reverse to the other end provided with the movable contact 21 of the movable plate 19 (an end fixed to the resin base 17) is disposed in the direction of getting away from the fixed contact 18 and terminal 16. Thus, Joule heating generated in the conduction path is directly conveyed from the movable contact 21 to the movable plate 19 supporting the bimetal element 22 and is never received from the conduction path by radiation and convection.

Thus, since in the thermal protector 15 of this preferred embodiment, the bimetal element 22 not only constitutes no conduction path but is also located in a position not affected by the heat generation of the conduction path, the bimetal element 22 is never inverted at lower temperature than its original operating temperature. Thus, larger current can be stably conducted.

When this thermal protector 15 is used for an electric circuit composed of an AC circuit, the above-described current direction indicated by the arrows a, b, c, d and e is naturally inverted every 50 or 60 cycles per second (in the case of Japan).

When this thermal protector 15 is used for an electric circuit composed of a DC circuit, it is preferable that one of the pair of terminals for connection with an external circuit, for example, the terminal 16*a* is made of nickel, iron plated with nickel or the like and is implemented as plus pole and that the other terminal 16*b* is made of copper or copper alloy and is implemented as minus pole.

In such a structure, when Joule heating occurs in the conduction path, Thomson effect acts since this heating becomes high in a contact part (part indicated by arrows b and d). Therefore, in the terminal 16*a*, heat moves in the direction reverse to the current direction indicated by an arrow a in FIG. 3 and in the terminal 16*b*, heat moves in the same direction as the current direction indicated by an arrow e in FIG. 3.

Specifically, Joule heating that has become high in a contact part moves to the outer ends of the terminals 16*a* and 16*b* by Thomson effect and the high heat in the contact part is cooled.

Since the outer ends of the terminals 16*a* and 16*b* are connected to an external electric circuit, and usually the terminals 16*a* and 16*b* and the external electric circuit are very firmly jointed, the Joule heating in this joint is lower than Joule heating in the contact part conducted only by pressure contact.

Therefore, Thomson effect functions to always move the heat generated in a contact part to the outer end of a terminal.

Second Embodiment

Figure 4A:
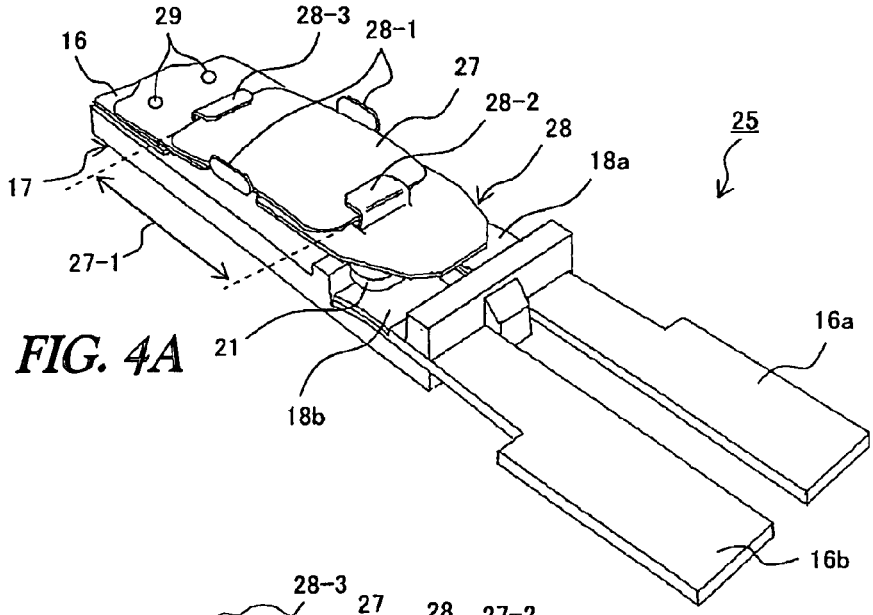
FIG. 4A is a perspective view illustrating the internal structure after removing a housing, of the thermal protector in the second preferred embodiment.
Figure 4B:
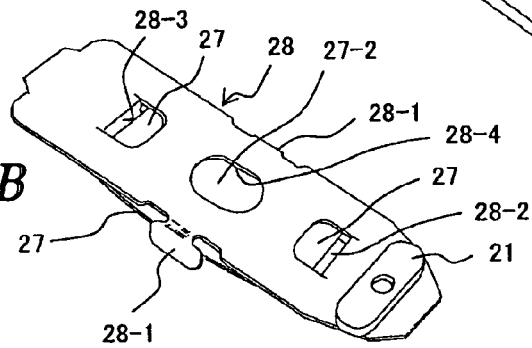
FIG. 4B is an exploded perspective view of the thermal protector illustrated in FIG. 4A (No. 1)
Figure 4C:
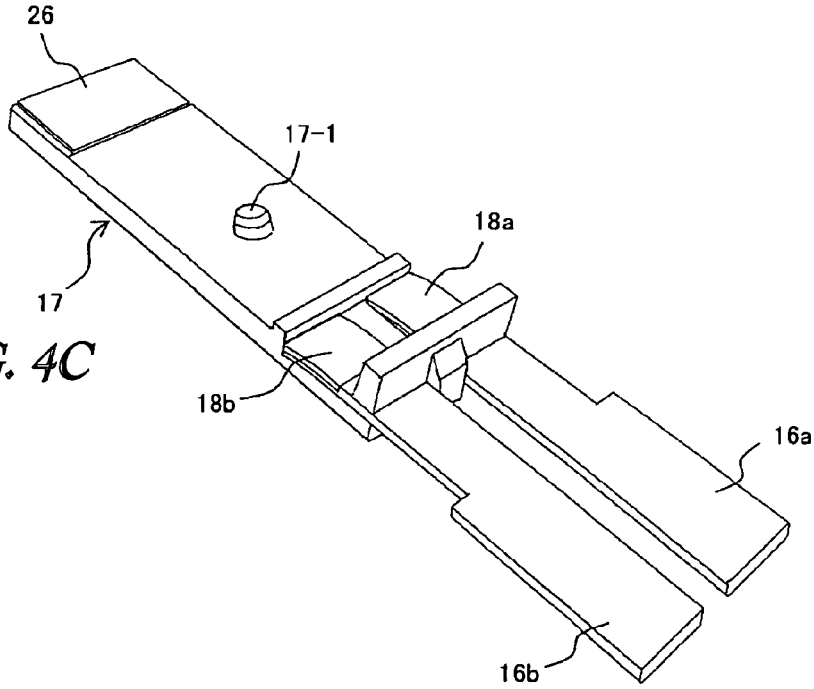
FIG. 4C is an exploded perspective view of the thermal protector illustrated in FIG. 4A (No. 2)

FIG. 4A is a perspective view illustrating the internal structure after removing a housing, of the thermal protector in the second preferred embodiment. FIGS. 4B and 4C are its exploded perspective views.

In FIG. 4B, the bimetal element and the movable plate illustrated in FIG. 4A are inverted upside down. In FIGS. 4A, 4B and 4C, the same reference numerals are attached to the same components and functions as those illustrated in FIGS. 2A, 2B and 2C.

As illustrated in FIGS. 4A, 4B and 4C, a thermal protector 25 in this preferred embodiment includes a pair of terminals 16 (16*a* and 16*b*) for connection with an external circuit. At the inner ends of the pair of terminals 16, fixed contacts 18 (18*a* and 18*b*) are formed. Then, the end on this fixed contact 18 side is fixed to the resin base 17.

In almost the center of the resin base 17, a somewhat cylinder-shaped projection 17-1 is formed and at the one end reverse to the other end at which the terminals 16 are fixed, a metal 26 is fixed.

The entire bimetal element 27 in this preferred embodiment 27 is composed of an inversion area 27-1. This bimetal element 27 is engaged in an invertible way with a rectangular movable plate 28 made of an elastic material at almost the center of the movable plate 28.

Specifically, both ends in the shorter side direction of the bimetal element 27 are restricted in their movement in the lateral direction by a restriction hook 28-1 stood on the both ends in the shorter side direction of the movable plate 28 and both ends in the longitudinal direction of the bimetal element 27 are engaged with hooks 28-2 and 28-3, respectively, cut and formed almost in the middle between the center and both ends in the longitudinal direction of the movable plate 28.

A combination of the movable plate 28 illustrated in FIG. 4B and the bimetal element 27 entirely engaged with this movable plate 28 is inverted upside down, is mounted on the resin base 17 illustrated in FIG. 4C and is fixed to the metal 26 by the at least two welding points 29 at the one end reverse to the other end on which the movable contact 21 of the movable plate 28 is formed.

Thus, the longitudinal direction side of the bimetal element 27 engaged with the hook 28-3 located between the center of the movable plate 28 and the one end reverse to the other end provided with the movable contact 21 is fixed to the resin base 17 via the movable plate 28.

In this state, since the bimetal element 27 is set to be convex upward in FIG. 4A at normal temperature, the movable contact 21 of the movable plate 28 is contacted on the fixed contact 18 by prescribed contact pressure.

In this state, the tip of the projection 17-1 of the resin base 17 goes through the dummy hole 28-4 of the movable plate 28 and the projection 17-1 is disposed close to the center 27-2 of the bimetal element 27 in such a way to almost contact the center 27-2.

Thus, when the bimetal element 27 is inverted at prescribed high temperature, that is, it is inverted in a concave shape upward, the end of the bimetal element 27 engaged with the hook 28-2 on the movable contact 21 side of the movable plate 28 is lifted since the bimetal element 27 is fixed to the resin base 17 by the hook 28-3 on the one side reverse to the other side provided with the movable contact 21 of the movable plate 28. Thus, the fixed contacts 18*a* and 18*b* are released to shut current.

Next, the positional relationship between the inversion area of the bimetal element 27 in this preferred embodiment, that is, a thermo-sensitive reaction area and the conduction path area of load current in an internal disposition space, that is, a disposition space inside the housing, which is not illustrated in FIG. 4, will be explained.

Figure 5:
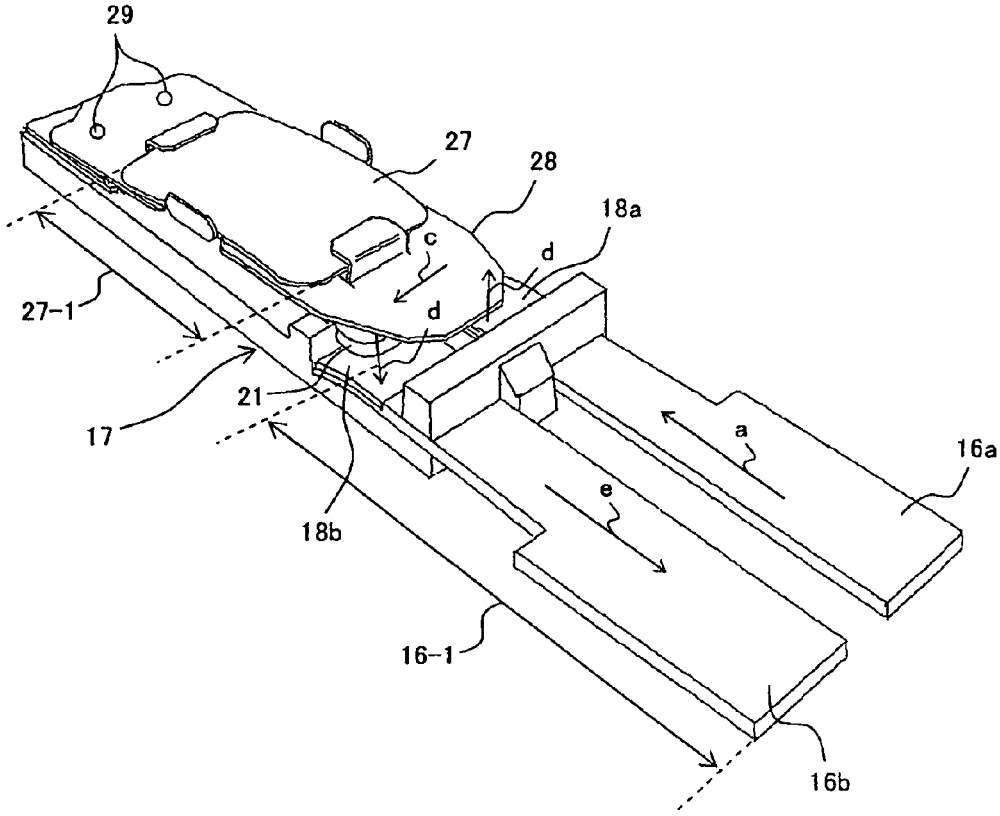
FIG. 5 is the perspective view of the thermal protector illustrated in FIG. 2A illustrating the positional relationship between the inversion area of the bimetal element and the conduction path area of load current.

FIG. 5 is the perspective view of the internal structure of the thermal protector 25 in this preferred embodiment illustrated in FIG. 4A after removing a housing.

In FIG. 5, if the terminals 16*a* and 16*b* are assumed to be plus and minus poles, respectively, when the fixed contacts 18*a* and 18*b* are closed, current flows from the terminal 16*a* to the terminal 16*b* via the fixed contact 18*a*, the movable contact 21 and the fixed contact 18*b* as indicated by arrows a, b, c, d and e.

In the conduction area 16-1 where a conduction path indicated by these arrows a, b, c, d and e is formed, this conduction area 16-1 and the inversion area 27-1 of the bimetal element 27 do not overlap at all. Therefore, the bimetal element 27 never receives Joule heating generated in the conduction path by radiation and convection.

In this preferred embodiment too, the one end reverse to the other end provided with the movable contact 21 of the movable plate 28 (the end fixed to the resin base 17) is disposed in the direction of getting away from the fixed contact 18 and the terminal 16.

Thus, since in the thermal protector 15 of this preferred embodiment, the bimetal element 27 not only constitutes no conduction path but also is located in a position affected by the heat generation of the conduction path, the bimetal element 22 is never inverted at lower temperature than its original operating temperature. Thus, Joule heating generated in the conduction path is directly conveyed from the movable contact 21 to the movable plate 19 supporting the bimetal element 27 and is never received from the conduction path by radiation and convection.

Thus, since in the thermal protector 25 of this preferred embodiment, the bimetal element 27 not only constitutes no conduction path but also is located in a position not affected by the heat generation of the conduction path, the bimetal element 27 is never inverted at lower temperature than its original operating temperature. Thus, larger current can be stably conducted.

In this preferred embodiment too, when this thermal protector 25 is used for an electric circuit composed of an AC circuit, if the terminals 16*a* and 16*b* are structured as illustrated in FIG. 3, Joule heating that has become high in the contact part moves toward the outer ends of the terminals 16*a* and 16*b* by Thomson effect and the high heat in the contact part is cooled.

Furthermore, since in the above-described thermal protectors in the first and second preferred embodiments, each of the terminals 16*a* and 16*b* is composed of a plate-shaped member that functions as a heat radiation surface, Joule heating that has moved toward the outer ends of the terminals 16*a* and 16*b* by Thomson effect is further cooled.

Furthermore, if the fixed contacts 18 (18*a* and 18*b*) and the movable contact 21 are made of the same silver-family material and the movable contact 21 is united as illustrated in FIGS. 2B and 4B instead of forming a pair corresponding to the pair of fixed contacts 18, the contact resistance of the contact part can be suppressed and the heat generation of the contact can be reduced.

Third Embodiment

Figure 6A:
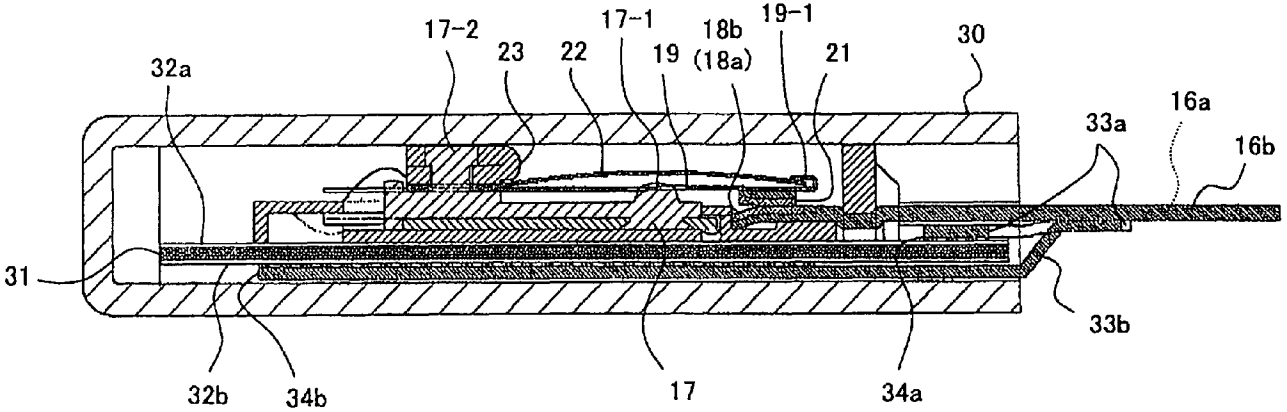
FIG. 6A is a side sectional view illustrating the structure of the thermal protector in the third preferred embodiment (No. 1)
Figure 6B:
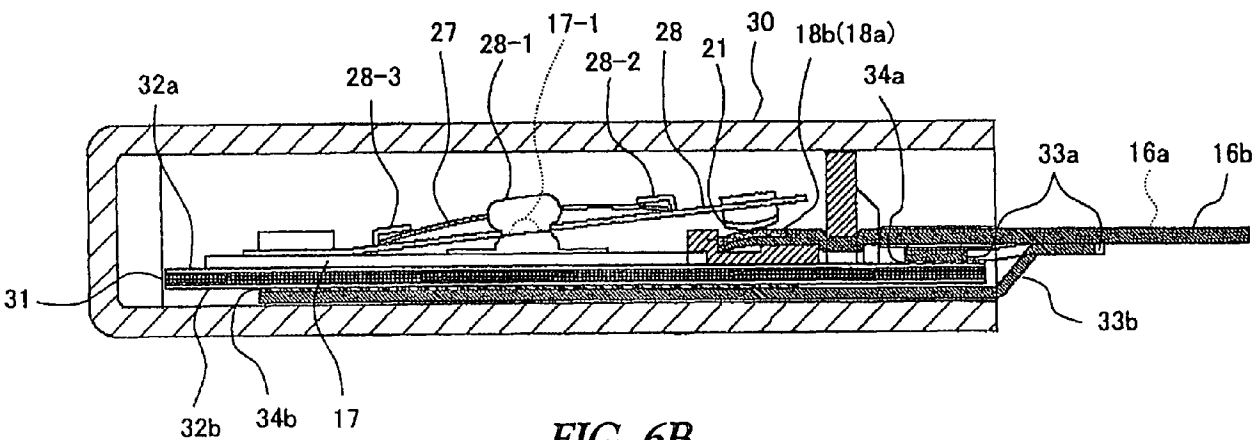
FIG. 6B is a side sectional view illustrating the structure of the thermal protector in the third preferred embodiment (No. 2).

FIGS. 6A and 6*b* are side sectional views illustrating the structure of the thermal protector in the third preferred embodiment. FIG. 6A illustrates a state where a PTC (positive temperature coefficient) 31 is built in the base of the housing 30 of the thermal protector main body having the same structure as the thermal protector in the first preferred embodiment.

FIG. 6B illustrates a state where a PTC (positive temperature coefficient) 31 is built in the base of the housing 30 of the thermal protector main body having almost the same positional relationship between the inversion area of the bimetal element and the conduction path area of load current as the thermal protector in the second preferred embodiment although the third preferred embodiment slightly differs from the thermal protector in the second preferred embodiment in the shape of the resin base 17 and the way of fixing the movable plate 28 to the resin base 17.

In FIGS. 6A and 6B, a pair of terminals 16 (16*a* and 16*b*) and the electrodes 32 (32*a* and 32*b*) of the PTC 31 are connected in parallel by conductive connection materials 33 (33*a* and 33*b*) and resistor materials 34 (34*a* and 34*b*).

Thus, in the thermal protector in this preferred embodiment, when the fixed contacts 18 (18*a* and 18*b*) are closed, an external electric circuit is conducted via the terminals 16 (16*a* and 16*b*). However, when internal temperature rises beyond prescribed temperature, the bimetal element 22 (or 27) is inverted and the fixed contacts 18 are released, voltage generated between the pair of terminals 16 (16*a* and 16*b*) is applied to the PTC 31.

Thus, the PTC 31 generates heat, the bimetal element 22 (or 27) is kept inverted by this heat generation and the thermal protector main body is held by itself.

This self-holding state is maintained until the conduction of the external electric circuit is compulsively shut, voltage application from the pair of terminals 16 (16*a* and 16*b*) to the PTC 31 is released and the internal temperature falls below the prescribed temperature.

INDUSTRIAL APPLICABILITY

As described above, the thermal protector of the present invention can be used in all industries needing a switch for sensing temperature and excess current and shutting current.

The invention claimed is:

1. A thermal protector, comprising:

a pair of terminals for connection with an external circuit, the pair of terminals located in a conduction area;

a pair of fixed contacts constituting a switch part of an electric circuit formed in the pair of terminals, the pair of fixed contacts located in an overlapping portion of the conduction area;

a movable plate composed of an elastic plate provided with a single movable contact at a first end of the movable plate, the single movable contact located in the overlapping portion and opposed to the pair of fixed contacts, the moveable plate operable for generating a prescribed contact pressure to the pair of fixed contacts by urging the single movable contact to directly contact each of the pair of fixed contacts, the pair of fixed contacts are operable to electrically insulate the pair of terminals when the single movable contact is not in direct contact with the pair of fixed contacts, and are operable to electrically conductively couple the pair of terminals when the single movable contact is in direct contact with the pair of fixed contacts; and a bimetal element engaged with the movable plate, the bimetal element being inverted in a direction of bending backward at a prescribed temperature so that the bimetal element drives the movable plate to switch on/off the pair of fixed contacts via the single movable contact, wherein the movable plate is disposed in a direction so that a second end of the movable plate distal to the first end of the movable plate extends away from the fixed contacts and extends beyond the conduction area and extends beyond the overlapping portion in a direction that is different from and not adjacent to the conduction area, wherein Joule heating generated in the conduction path is directly conveyed from the movable contact to the movable plate and bimetal element is never received from the conduction path by radiation and convection, and the bimetal element is structured in such a way that a first end of the bimetal element is engaged with the first end of the movable plate provided with the single movable contact, and a second end of the bimetal element is engaged with the second end of the movable plate and wherein an overlap ratio of an inversion area of the bimetal element to the conduction area is equal to ⅓ or less.

2. The thermal protector according to claim 1, wherein the bimetal element comprises the inversion area and a non-inversion area and is disposed on top of the movable plate, wherein an end of the non-inversion area is fixed to the movable plate, a tip of the inversion area is engaged with an end side provided with the single movable contact of the movable plate and normally the bimetal element presses the single movable contact of the movable plate toward the pair of fixed contacts.

3. The thermal protector according to claim 2, further including:

a fixing member for fixing the first end of the bimetal element to the movable plate, and a base of a thermal protector main body coupled to the pair of terminals and that is composed of a metal insulated from the pair of terminals.

4. The thermal protector according to claim 1, wherein one end of the bimetal element is engaged with the movable plate in a position deviated in a direction of an end reverse to a top end provided with the movable contact of the movable plate, the other end of the bimetal element is engaged with one end reverse to the other end provided with the single movable contact of the movable plate and its inversion area does not overlap the conduction area of load current in an internal disposition space.

5. The thermal protector according to claim 1, wherein the electric circuit is a DC circuit, and a first one of the pair of terminals for connection with the external circuit is made of copper or copper alloy, and a second one of the pair of terminals is made of nickel or iron plated with nickel.

6. The thermal protector according to claim 5, wherein the first one of the pair of terminals is a minus pole, and the second one of the pair of terminals is a plus pole.

7. The thermal protector according to claim 1, wherein the pair of fixed contacts and the single movable contact are made of a silver-family material.

8. The thermal protector according to claim 1, wherein each of the pair of terminals for connection with the external circuit is composed of a plate-shaped member which functions as a heat radiation surface.

9. The thermal protector according to claim 1, wherein a positive temperature coefficient element built in a base of a thermal protector main body, the pair of terminals including electrodes passing through the positive temperature coefficient element, wherein the electrodes are arranged in parallel, and when the pair of fixed contacts is released, the bimetal element is held by itself by heat generation by voltage applied to the positive temperature coefficient element from the pair of terminals.

10. The thermal protector according to claim 1, wherein the inversion area of the bimetallic element and conduction area do not overlap at all.

* * * * *